US009334620B2

(12) United States Patent
Brockway

(10) Patent No.: US 9,334,620 B2
(45) Date of Patent: May 10, 2016

(54) COMPACTION WHEEL CLEAT

(71) Applicant: Terra Compactor Wheel Corp., Plymouth, WI (US)

(72) Inventor: Robert John Brockway, Plymouth, WI (US)

(73) Assignee: Terra Compactor Wheel Corp., Plymouth, WI (US)

( * ) Notice: Subject to any disclaimer, the term of this patent is extended or adjusted under 35 U.S.C. 154(b) by 0 days.

(21) Appl. No.: 14/328,912

(22) Filed: Jul. 11, 2014

(65) Prior Publication Data

US 2016/0010301 A1 Jan. 14, 2016

(51) Int. Cl.
*E02D 3/02* (2006.01)
*E02D 3/026* (2006.01)

(52) U.S. Cl.
CPC ..... *E02D 3/0265* (2013.01)

(58) Field of Classification Search
CPC ..... E02D 3/0265; E02D 3/026
USPC ..... 404/121
See application file for complete search history.

(56) References Cited

U.S. PATENT DOCUMENTS

| | | | | |
|---|---|---|---|---|
| 1,011,001 | A | 12/1911 | Wright | |
| 3,687,023 | A | 8/1972 | Moser et al. | |
| 3,823,983 | A | 7/1974 | Peterson | |
| 3,891,341 | A | 6/1975 | Trainor et al. | |
| 4,074,942 | A * | 2/1978 | Cochran | 404/121 |
| 4,530,620 | A | 7/1985 | McCartney | |
| 4,668,122 | A | 5/1987 | Riddle | |
| 4,919,566 | A | 4/1990 | Caron et al. | |
| H000946 | H * | 8/1991 | Lonn | 404/121 |
| 5,217,321 | A * | 6/1993 | Corcoran et al. | 404/121 |
| 5,217,322 | A * | 6/1993 | Corcoran et al. | 404/121 |
| 5,358,355 | A | 10/1994 | Brockway | |
| 6,712,551 | B2 * | 3/2004 | Livesay et al. | 404/124 |
| 7,108,452 | B2 * | 9/2006 | Caron et al. | 404/124 |
| 7,198,333 | B1 * | 4/2007 | Freeman | 301/43 |
| 7,959,375 | B2 * | 6/2011 | Brockway | 404/121 |
| 8,333,439 | B2 * | 12/2012 | Gibbins | 301/44.1 |
| 8,449,218 | B2 * | 5/2013 | McPhail et al. | 404/124 |
| 8,496,402 | B2 * | 7/2013 | McPhail et al. | 404/124 |
| 2009/0045669 | A1 * | 2/2009 | McPhail et al. | 301/43 |
| 2012/0003041 | A1 * | 1/2012 | McPhail et al. | 404/121 |
| 2013/0025890 | A1 * | 1/2013 | Schoepke et al. | 172/554 |
| 2014/0062166 | A1 * | 3/2014 | Crystal et al. | 301/43 |

* cited by examiner

*Primary Examiner* — Abigail A Risic
(74) *Attorney, Agent, or Firm* — Ziolkowski Patent Solutions Group, SC

(57) ABSTRACT

A compactor cleat includes a bottom face affixable to a compactor wheel and having a perimeter defining an outline of the compactor cleat, a cutting face distal from the bottom face and radially outward from the compactor wheel, a pair of side faces extending between the bottom face and the cutting face, and a pair of traction faces positioned between the pair of side surfaces on opposing sides of the compactor cleat and extending between the bottom face and the cutting face. Each traction face comprises a bi-facial traction face that includes a first section including a sloped surface extending downwardly and outwardly from the cutting face towards the bottom face for less than a full height of the compactor cleat, and a second section formed adjacent the first section that has a concave surface that forms a transition between the second section and the perimeter of the bottom face.

19 Claims, 3 Drawing Sheets

COMPACTION WHEEL CLEAT

BACKGROUND OF THE INVENTION

The invention relates generally to compaction machines, such as those used to compact landfills and, more particularly, to cleats of a compactor wheel on such a compaction machine, with the cleats designed to reduce the amount of waste build-up on the compactor wheel.

Compaction machines are used to compact landfill sites, garbage dumps and other such locations. These machines typically include a self-propelled vehicle having four large compactor wheels made of steel. Each compactor wheel has a hub mounted to one end of an axle and a rim disposed around and radially out from the hub. The rim typically includes an outer wrapper on which a plurality of cleats is usually mounted. The design of conventional compactor wheels, and in particular the compactor wheel cleats, varies widely. In general, the cleats are designed to compress (i.e., compact) the waste by concentrating the weight of the compaction machine on the relatively small area of the cleats. The cleats also function to break apart waste by imparting breaking forces thereon.

One problem encountered with existing cleat designs is that waste can build-up on the cleats over time. That is, as the compactor wheel traverses the surface of the landfill and waste is compressed by the cleats, waste may build-up in crevices/depressions in the cleat, or may be punctured by the cleat and thereby become stuck on the cleat. Such accumulation of debris on the cleats is undesirable, as it minimizes the efficiency of the cleats with respect to its ability to impart compression and breaking forces on the waste being compacted and to provide traction to the compaction machine.

It would therefore be desirable to have a system and method capable of providing a cleat that minimizes the build-up of waste thereon. It would further be desirable for such a cleat to provide efficient compression and breaking forces on the waste being compacted.

BRIEF DESCRIPTION OF THE INVENTION

Embodiments of the invention provide a compactor wheel and compaction cleat mounted thereon, with the compaction cleat configured to reduce the amount of refuse build-up on the compactor wheel and provide efficient compression and breaking forces to waste being compacted by the compactor wheel.

In accordance with one aspect of the invention, a compactor cleat mountable on a compactor wheel includes a bottom face affixable to a compactor wheel and having a perimeter defining an outline of the compactor cleat, a cutting face distal from the bottom face and radially outward from the compactor wheel, a pair of side faces extending between the bottom face and the cutting face, and a pair of traction faces positioned between the pair of side surfaces on opposing sides of the compactor cleat and extending between the bottom face and the cutting face. Each of the pair of traction faces comprises a bi-facial traction face that includes a first section including a sloped surface extending downwardly and outwardly from the cutting face towards the bottom face, the sloped surface extending downwardly less than a full height of the compactor cleat, and a second section formed adjacent the first section, the second section comprising a concave surface that forms a transition between the second section and the perimeter of the bottom face.

In accordance with another aspect of the invention, a compactor cleat mountable on a compactor wheel includes a bottom face affixable to a compactor wheel and comprising a perimeter defining an outline of the compactor cleat, a top face distal from the bottom face so as to form a top surface of the compactor cleat, a pair of side faces extending between the bottom face and the top face, and a pair of traction faces extending between the bottom face and the top face and being positioned between the pair of side surfaces and on opposing sides of the compactor cleat. Each of the pair of traction faces comprises a bi-facial traction face that includes a first section and a second section arranged in a side-by-side arrangement, with the first and second sections of one traction face being opposed from the first and second sections of the other traction face.

In accordance with yet another aspect of the invention, a compactor wheel mountable on an axle of a compaction machine includes a hub mountable to an axle of a compaction machine and a rim mounted around an outer circumference of the hub, the rim having a wrapper, an inner circumferential edge, and an outer circumferential edge. The compactor wheel also includes a plurality of cleats affixed to the wrapper, with each of the plurality of cleats further including a bottom face affixable to the wrapper, a cutting face positioned radially outward from the wrapper so as to be distal from the bottom face, a pair of side faces extending between the bottom face and the cutting face, and a pair of traction faces extending between the bottom face and the cutting face and being positioned between the pair of side surfaces and on opposing sides of the cutting face, wherein the cutting face comprises a flat, polyomino shaped cutting face that causes each of the pair of traction faces to have a bi-facial construction.

Various other features and advantages will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION

Figure 1:
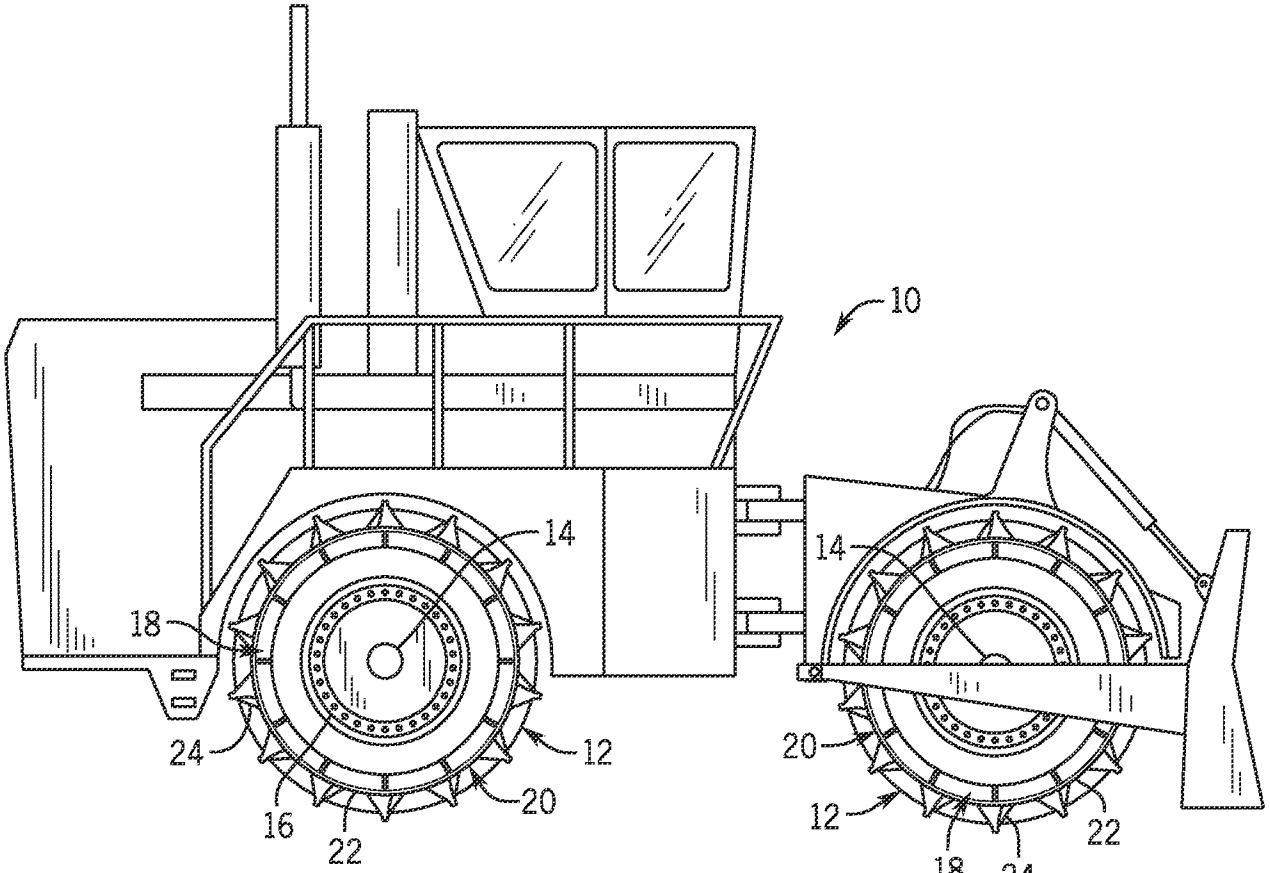
FIG. 1 is a side view of a compaction machine having compactor wheels mounted thereon for use with embodiments of the invention.

Referring to FIG. 1, a compaction machine 10 is shown that includes compactor wheels 12 mounted on axles 14 of the compaction machine 10. The present invention is not intended to be limited to any particular type of compaction machine 10 and may be used on any suitable compaction machine. The wheels 12 include a hub 16 adapted, for example, with a plurality of bolt holes for being bolted or otherwise mounted to the axle 14. A rim 18 is mounted around the hub 16. The rim 18 includes a wrapper 20 with an outer face or surface 22 on which a plurality of cleats 24 (i.e., teeth) are mounted, such as by welding or any other suitable technique. The cleats 24 can be mounted in any of a variety of patterns, as desired, such as being aligned in a plurality of rows, for example.

Referring to FIGS. 2-5, the construction of cleat 24 is shown from various views according to an exemplary embodiment of the invention. The cleat 24 is formed to generally include a flat cutting face 26 at the apex of the cleat 14, opposite traction faces 28, 30, opposite side faces 32, 34 located on either side of the traction faces 28, 30, and a bottom face 36. According to one embodiment of the invention, the cleat 24 is formed to have a generally hollow or semi-hollow construction, with the bottom face 36 having a perimeter 38 that defines a cavity 40 formed in the cleat 24 (FIG. 5), with the perimeter 38 also generally defining a shape/outline of the cleat 24. The cavity 40 extends up into the cleat 24 to form the hollow or semi-hollow interior of the cleat 24, with the hollow cavity 40 reducing the weight of the cleat 24.

The bottom face 36 of cleat 24 is formed so as to be securable to wrapper 20 (FIG. 1), and may thus present a curved face that matches a contour of the wrapper 20. The bottom face 36 may provide for welding of the cleat 24 to the compactor wheel 12 or for another means for engaging the cleat 24 to the compactor wheel 12, such as in a twist-lock fashion, for example. The bottom face 36 is formed such that the perimeter 38 thereof includes linear/straight portions 42 and curved portions 44. The straight portions 42 of the bottom face 36 are located along the side faces 32, 34 and on a part of the traction faces 28, 30, with the curved portions 44 of the bottom face 36 being located along a remaining part of the traction faces 28, 30. The curved portions 44 of the bottom face perimeter 38 provide a non-stick feature to the cleat 24 hat works in combination with the fraction faces 28, 30 and side surfaces 32, 34 to prevent material from sticking to and building up on the cleat 24, as will be explained in greater detail below Each of the side faces 32, 34 is formed at an angle so as to slope upwardly and inwardly from the perimeter 38 of bottom face 36 to the cutting face 26. According to an embodiment of the invention, side faces 32, 34 are formed as planar, angled surfaces that extend upwardly and inwardly from the bottom face 36 to the cutting face 26.

Figure 2:
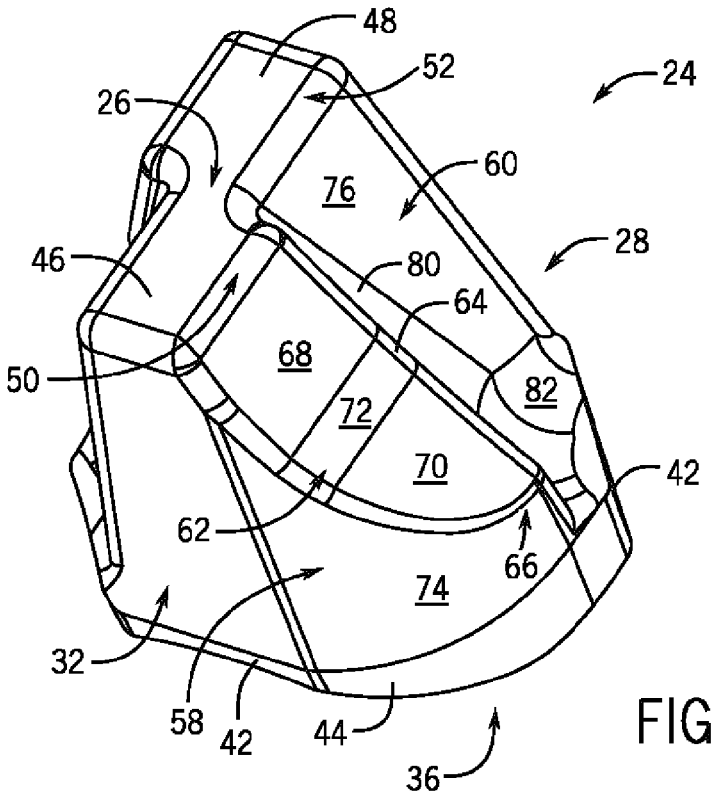
FIGS. 2 and 3 are perspective views of a compactor wheel cleat according to an embodiment of the invention.
Figure 3:
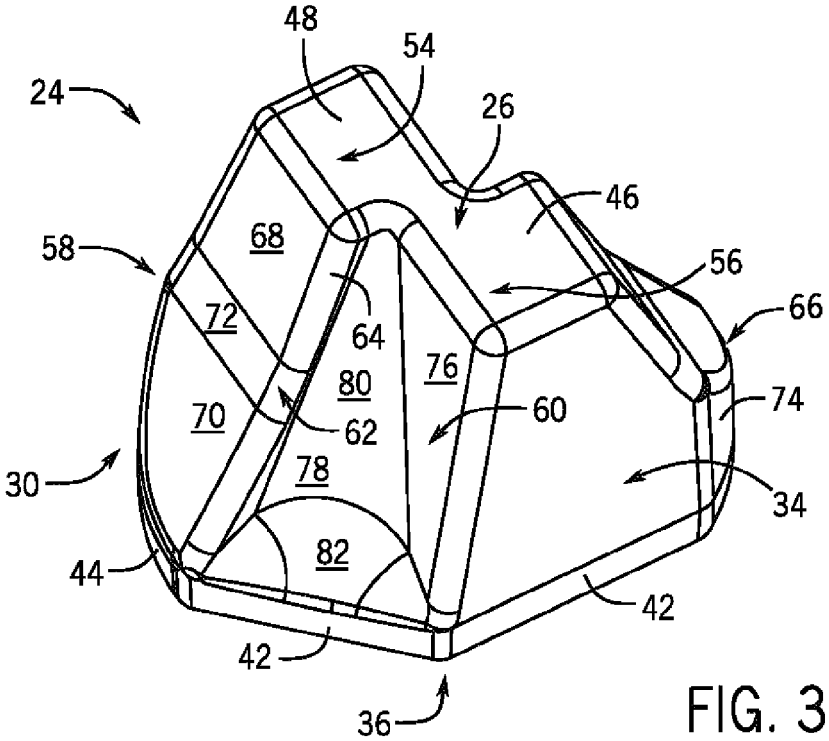
Figure 4:
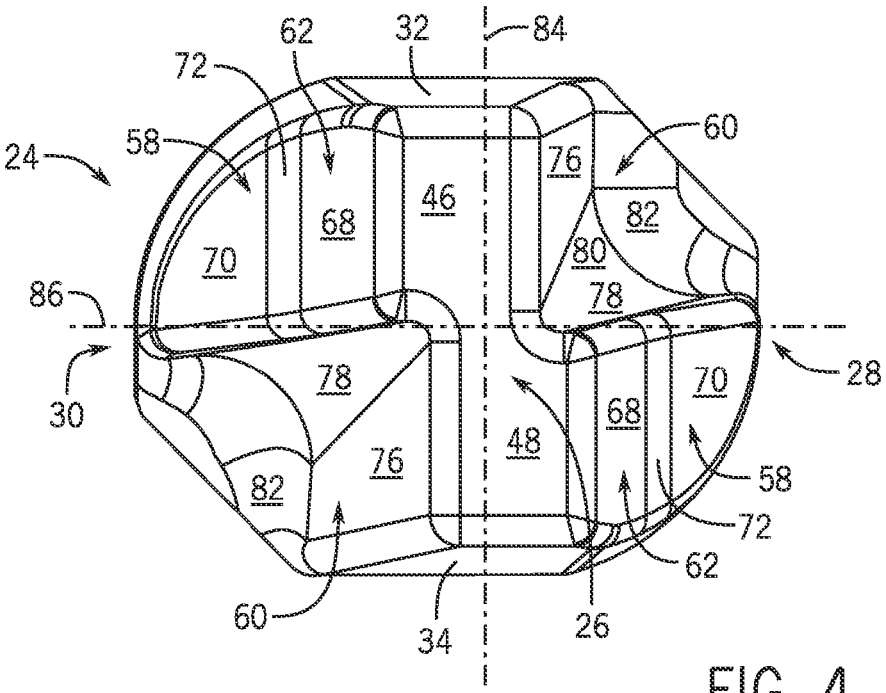
FIG. 4 is a top view of the compactor wheel cleat of FIGS. 2 and 3.
Figure 5:
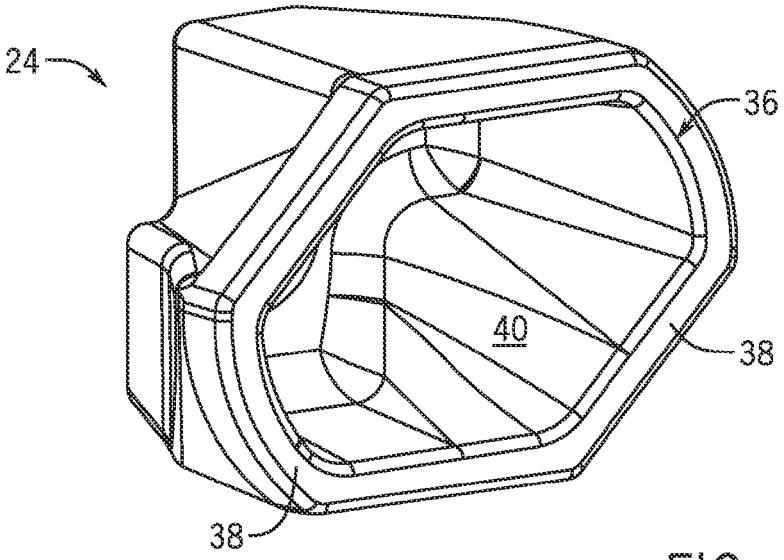
FIG. 5 is a bottom view of the compactor wheel cleat of FIGS. 2 and 3.

As best shown in FIGS. 2-4, the cutting face 26 of cleat 24 can generally be described as having a polyomino shape—with a pair of identical shaped portions 46, 48 (i.e., square or rectangular shaped portions) of the cutting face 26 being aligned edge-to-edge and offset from one another. The polyomino shape of the cutting face 26 contributes to each of the traction faces 28, 30 of the cleat having a bi-facial design, with edge 50 of cutting face portion 46 and edge 52 of cutting face portion 48 (offset from edge 50) defining an upper edge of traction face 28 and edge 54 of cutting face portion 48 and edge 56 of cutting face portion 46 (offset from edge 54) defining an upper edge of traction face 30.

As indicated above, each of the traction faces 28, 30 has a bi-facial design that can generally be divided into two distinct facets or sections—generally referred to hereafter as a first section 58 and a second section 60. The first section 58 of each traction face 28, 30 includes a sloped surface 62 that generally slopes downwardly and outwardly from cutting face 26 (from edge 50 of cutting face portion 46 for traction face 28 and from edge 54 of cutting face portion 48 for fraction face 30) toward the perimeter 38 of the bottom face 36. The sloped surface 62 is defined by a linear edge 64 that is adjacent second section 60 and an arcuate edge 66 that extends from a junction of the cutting face 26 and a respective side face 32, 34 downwardly and inwardly toward the linear edge 64. The linear edge 64 and the arcuate edge 66 taper a width of the sloped surface 62 as the surface extends downwardly so as to form a knife-shaped sloped surface 62 that slopes downwardly and outwardly from cutting face 26 toward the perimeter 38 of the bottom face 36.

According to an exemplary embodiment, the sloped surface 62 is formed as a non-planar surface that includes two distinct sloped sections thereon. A first sloped section 68 is formed adjacent cutting face 26 and is formed at a first angle, with the first sloped section 68 transitioning to a second sloped section 70 (via a smooth transition section 72) that is formed at a second angle. As an example, the first sloped section 68 may be formed to have a descending angle of 67.7° and the second sloped section 70 may be formed to have a descending angle of 58.0°. The greater angle of first sloped section 68—as compared to the second sloped section 70—may promote an increased cutting force on waste material due to the sharper angle between cutting face 26 and traction face 28, 30, while the lesser angle of second sloped section 70 promotes movement of the waste material in an outward motion off of the traction face 28, 30.

As is shown in FIGS. 2 and 3, the sloped surface 62 of the first section 58 of the traction face 28, 30 extends only partially down to the perimeter 38 of bottom face 36 (i.e., less than a full height of the cleat), with the arcuate edge 66 of the sloped surface 62 delineating a transition of the sloped surface 62 to a more sheer vertical surface 74 of the first section 58 that extends between the sloped surface 62 and the perimeter 38 of the bottom face 36 of the cleat 24. This more sheer vertical surface 74 of first section 58 follows a contour of the arcuate edge 66 and extends from a side surface 32, 34 of the cleat 24 to the linear edge 64 of the first section 58. The surface 74 follows a curved portion 44 of the perimeter 38 of bottom face 36 and thus presents a smooth transition from the respective side surface 32, 34 of the cleat 24 to the first section 58 of the respective traction face 28, 30.

The second section 60 of each traction face 28, 30 is formed to have a more vertical face as compared to the first section 58 (i.e., the sloped surface 62 of first section 58). The second section 60 of each traction face 28, 30 can generally be described as a pocket or cut-out portion of the cleat 24. The second section 60 has a surface 76 that extends downwardly from the cutting face 26 (from edge 52 of cutting face portion 48 for traction face 28 and from edge 56 of cutting face portion 46 for traction face 30) in a nearly vertical manner toward the bottom face 36, with the surface 76 being formed along a width of the edge 52, 56 of the respective cutting face portion 46, 48. As an example, surface 76 may be oriented at a descending angle of 78° from the cutting face 26 to the bottom face 36. A surface 78 of second section 60 also extends downwardly from the cutting face 26 toward bottom face 36, with the surface 78 being formed adjacent first section 58 of traction face 28, 30 along the linear edge 64 of sloped surface 62—such that the surface 78 can be said to also form a side surface of the first section 58. The surface 78 is oriented so as to be generally perpendicular to surface 76 along a height of the cleat 24, with a transition between surface 76 and surface 78 of the second section 60 being provided by way of a fillet 80 of a desired radius (e.g., 0.25 to 2.00"), so as to present a smooth transition between the faces.

As is shown in FIGS. 2-4, surfaces 76, 78 of the second section 60 of each traction face 28, 30 transition or "blend" to the perimeter 38 of the bottom face 36 by way of a concave surface 82 (i.e., bowl-shaped feature/surface). The concave surface 82 functions to provide a smooth transition between the surfaces 76, 78 and the perimeter 38 of the cleat—with the edge of the concave surface 82 being formed along a linear/straight portion 42 of the perimeter 38 of bottom face 36. The concave surface 82 is formed with a radius of desired size, such as a radius of 0.125 to 1.50", for example.

The second section 60 of each traction face 28, 30 provides a desirable cutting force on waste material due to the sharp angle between cutting face 26 and surfaces 76, 78 of the second section 60, and also provides for movement of the waste material in an outward motion off of the traction face 28, 30 by way of the concave surface 82.

As can be seen in FIGS. 2-4, the compaction cleat 24 is thus formed having matching opposed directional traction faces 28, 30, with the cleat being symmetrical about a dividing line 84 and about a dividing line 86. The bi-facial traction faces 28, 30 are mirror images of one another and include matching sets of first and second sections 58, 60. In operation, waste is pressed onto cleat 24 during rotation of compactor wheel 12 and is generally directed to each of the opposing traction faces 28, 30 formed on opposing sides of the cutting face 26. Waste is then forced into four separate directions by way of traction faces 28, 30—along the first section 58 and second section 60 of each fraction face—thus breaking apart waste as it is pressed onto cleat 24. As such, the amount of waste or debris that builds up on the cleat 24 is minimized and the compactor wheel 12 is kept cleaner, while providing desired fraction on the compactor wheel.

In manufacturing the cleat 24, it is recognized that any of a number of suitable techniques may be employed, depending on the material from which the cleat is formed. As one example, satisfactory cleats have been produced by hot forging blanks (not shown) made of 15B37 steel using well known hot forging techniques. An upper portion of about the top half of each cleat 24 is preferably heat treated to a hardness within the range of about RC 52-58, with the lower balance of each cleat 24 having a hardness within the range of about RC 20-30. The bottom face 36 of each cleat 24 can be mounted to the wrapper 20 of each of the wheels in any acceptable manner. Satisfactory results have been obtained by welding each cleat 24 to its respective wrapper 20. The cleat 24 may also be formed of a mild carbon A136 steel, for example, that can be hammer forged to a desired shape or a high chromium steel, for example, that can be casted into a desired shape.

Therefore, according to one embodiment of the invention, a compactor cleat mountable on a compactor wheel includes a bottom face affixable to a compactor wheel and having a perimeter defining an outline of the compactor cleat, a cutting face distal from the bottom face and radially outward from the compactor wheel, a pair of side faces extending between the bottom face and the cutting face, and a pair of traction faces positioned between the pair of side surfaces on opposing sides of the compactor cleat and extending between the bottom face and the cutting face. Each of the pair of traction faces comprises a bi-facial traction face that includes a first section including a sloped surface extending downwardly and outwardly from the cutting face towards the bottom face, the sloped surface extending downwardly less than a full height of the compactor cleat, and a second section formed adjacent the first section, the second section comprising a concave surface that forms a transition between the second section and the perimeter of the bottom face.

According to another embodiment of the invention, a compactor cleat mountable on a compactor wheel includes a bottom face affixable to a compactor wheel and comprising a perimeter defining an outline of the compactor cleat, a top face distal from the bottom face so as to form a top surface of the compactor cleat, a pair of side faces extending between the bottom face and the top face, and a pair of traction faces extending between the bottom face and the top face and being positioned between the pair of side surfaces and on opposing sides of the compactor cleat. Each of the pair of traction faces comprises a bi-facial traction face that includes a first section and a second section arranged in a side-by-side arrangement, with the first and second sections of one traction face being opposed from the first and second sections of the other traction face.

According to yet another embodiment of the invention, a compactor wheel mountable on an axle of a compaction machine includes a hub mountable to an axle of a compaction machine and a rim mounted around an outer circumference of the hub, the rim having a wrapper, an inner circumferential edge, and an outer circumferential edge. The compactor wheel also includes a plurality of cleats affixed to the wrapper, with each of the plurality of cleats further including a bottom face affixable to the wrapper, a cutting face positioned radially outward from the wrapper so as to be distal from the bottom face, a pair of side faces extending between the bottom face and the cutting face, and a pair of traction faces extending between the bottom face and the cutting face and being positioned between the pair of side surfaces and on opposing sides of the cutting face, wherein the cutting face comprises a flat, polyomino shaped cutting face that causes each of the pair of traction faces to have a bi-facial construction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compactor cleat mountable on a compactor wheel, the compactor cleat comprising:

a bottom face affixable to a compactor wheel, the bottom face comprising a perimeter defining an outline of the compactor cleat;

a cutting face distal from the bottom face and radially outward from the compactor wheel;

a pair of side faces extending between the bottom face and the cutting face; and a pair of traction faces positioned between the pair of side surfaces on opposing sides of the compactor cleat and extending between the bottom face and the cutting face;

wherein each of the pair of traction faces comprises a bi-facial traction face that includes:

a first section including a sloped surface extending downwardly and outwardly from the cutting face towards the bottom face, the sloped surface extending downwardly less than a full height of the compactor cleat; and a second section formed adjacent the first section, the second section comprising a concave surface that forms a transition between the second section and the perimeter of the bottom face; and wherein the sloped surface of the first section comprises:

a linear edge adjacent the second section that extends downwardly and outwardly from the cutting face; and an arcuate edge extending from a junction of the cutting face and a respective side face downwardly and inwardly toward the linear edge, such that the arcuate edge meets the linear edge.

2. The compactor cleat of claim 1 wherein the pair of traction faces comprise opposed traction faces, with the first and second sections of one traction face being opposed with the first and second sections of the other traction face.

3. The compactor cleat of claim 2 wherein the linear edge and the arcuate edge define a knife-shaped sloped surface.

4. The compactor cleat of claim 2 wherein the first section of each traction face further comprises a curved surface having a more vertical orientation than the sloped surface and extending between the sloped surface and the perimeter of the bottom face, with the arcuate edge delineating a dividing line between the sloped surface and the curved surface such that the curved surface extends between a respective side face to the second section of the traction face.

5. The compactor cleat of claim 1 wherein the sloped surface of the first section comprises a non-planar surface that includes:

a first sloped section formed adjacent cutting face and oriented a first angle; and a second sloped section formed adjacent the first sloped section, the second sloped section being oriented at a second angle different from the first angle.

6. The compactor cleat of claim 1 wherein the second section of each traction face comprises:

a first surface extending downwardly from the cutting face to the concave surface; and a second surface extending downwardly from the cutting face to the concave surface and positioned adjacent the first section of the traction face;

wherein the first surface and the second surface of the second section are oriented generally perpendicular to one another along a height of the compactor cleat, with a smooth transition being provided between the first and second surfaces.

7. The compactor cleat of claim 6 wherein the first and second surfaces of the second section having a more vertical orientation than the sloped surface of the first section.

8. The compactor cleat of claim 1 wherein the cutting face comprises a flat, polyomino shaped cutting face.

9. The compactor cleat of claim 8 wherein the polyomino shaped cutting surface comprises a first portion and a second portion identical to the first portion, wherein opposing edges on each of the first portion and the second portion of the cutting face adjoin with the first section of one traction face and the second section of the other traction face.

10. The compactor cleat of claim 1 wherein the bottom face defines a cavity that extends up into the compactor cleat, so as to form a hollow or semi-hollow cleat.

11. A compactor cleat mountable on a compactor wheel, the compactor cleat comprising:

a bottom face affixable to a compactor wheel and comprising a perimeter defining an outline of the compactor cleat;

a top face distal from the bottom face so as to form a top surface of the compactor cleat;

a pair of side faces extending between the bottom face and the top face; and a pair of traction faces extending between the bottom face and the top face and being positioned between the pair of side surfaces and on opposing sides of the compactor cleat;

wherein each of the pair of traction faces comprises a bi-facial traction face that includes a first section and a second section arranged in a side-by-side arrangement, with the first and second sections of one traction face being opposed from the first and second sections of the other traction face;

wherein the first section of the bi-facial traction face includes a sloped surface extending downwardly and outwardly from the top face towards the bottom face, the sloped surface tapering in width as it extends downwardly; and wherein the sloped surface of the first section comprises:

a linear edge adjacent the second section that extends downwardly and outwardly from the top face; and an arcuate edge extending from a junction of the top face and a respective side face downwardly and inwardly toward the linear edge, so as to taper the width of the sloped surface.

12. The compactor cleat of claim 11 wherein the first section of each traction face further comprises a curved surface having a more vertical orientation than the sloped surface and extending between the sloped surface and the perimeter of the bottom face, with the arcuate edge delineating a dividing line between the sloped surface and the curved surface such that the curved surface extends between a respective side face to the second section of the traction face.

13. The compactor cleat of claim 11 wherein the second section of each traction face comprises:

a first surface extending downwardly from the top face;

a second surface extending downwardly from the top face and positioned adjacent the first section of the traction face, the second surface being oriented generally perpendicular to the first surface along a height of the compactor cleat; and a bowl-shaped surface formed below the first and second surfaces and near the bottom face of the compactor cleat, the bowl-shaped surface forming a smooth transition between first and second surfaces and the perimeter of the bottom face.

14. The compactor cleat of claim 13 wherein the first and second surfaces of the second section have a generally vertical orientation.

15. The compactor cleat of claim 11 wherein the top face comprises a flat, polyomino shaped cutting face.

16. A compactor wheel mountable on an axle of a compaction machine, the compactor wheel comprising:

a hub mountable to an axle of a compaction machine;

a rim mounted around an outer circumference of the hub, the rim having a wrapper, an inner circumferential edge, and an outer circumferential edge; and a plurality of cleats affixed to the wrapper, each of the plurality of cleats comprising:

a bottom face affixable to the wrapper;

a cutting face positioned radially outward from the wrapper so as to be distal from the bottom face;

a pair of side faces extending between the bottom face and the cutting face; and a pair of traction faces extending between the bottom face and the cutting face and being positioned between the pair of side surfaces and on opposing sides of the cutting face;

wherein the cutting face comprises a flat, polyomino shaped cutting face that causes each of the pair of traction faces to have a bi-facial construction; and wherein each of the traction faces comprises:

a first section including:

a sloped surface extending downwardly and outwardly from the cutting face towards the bottom face, the sloped surface being defined by a linear edge and an arcuate edge; and a curved surface positioned below the sloped surface so as to join the sloped surface to a perimeter of the bottom face, the curved surface having a more vertical orientation than the sloped surface; and a second section including:

a first surface extending downwardly from the cutting face;

a second surface extending downwardly from the cutting face and adjacent the first section so as to form a side surface thereof; and a bowl-shaped surface formed below the first and second surfaces and near the bottom face of the compactor cleat, the bowl-shaped surface forming a smooth transition between first and second surfaces and the perimeter of the bottom face.

17. The compactor wheel of claim 16 wherein the polyomino shaped cutting face consists of two identical square or rectangular shaped portions.

18. A compactor cleat mountable on a compactor wheel, the compactor cleat comprising:

a bottom face affixable to a compactor wheel, the bottom face comprising a perimeter defining an outline of the compactor cleat;

a cutting face distal from the bottom face and radially outward from the compactor wheel;

a pair of side faces extending between the bottom face and the cutting face; and a pair of traction faces positioned between the pair of side surfaces on opposing sides of the compactor cleat and extending between the bottom face and the cutting face;

wherein each of the pair of traction faces comprises a bi-facial traction face that includes:

a first section including a sloped surface extending downwardly and outwardly from the cutting face towards the bottom face, the sloped surface extending downwardly less than a full height of the compactor cleat; and a second section formed adjacent the first section, the second section comprising a concave surface that forms a transition between the second section and the perimeter of the bottom face;

wherein the second section of each traction face comprises:

a first surface extending downwardly from the cutting face to the concave surface; and a second surface extending downwardly from the cutting face to the concave surface and positioned adjacent the first section of the traction face;

wherein the first surface and the second surface of the second section are oriented generally perpendicular to one another along a height of the compactor cleat, with a smooth transition being provided between the first and second surfaces.

19. A compactor cleat mountable on a compactor wheel, the compactor cleat comprising:

a bottom face affixable to a compactor wheel and comprising a perimeter defining an outline of the compactor cleat;

a top face distal from the bottom face so as to form a top surface of the compactor cleat;

a pair of side faces extending between the bottom face and the top face; and a pair of traction faces extending between the bottom face and the top face and being positioned between the pair of side surfaces and on opposing sides of the compactor cleat;

wherein each of the pair of traction faces comprises a bi-facial traction face that includes a first section and a second section arranged in a side-by-side arrangement, with the first and second sections of one traction face being opposed from the first and second sections of the other traction face; and wherein the second section of each traction face comprises:

a first surface extending downwardly from the top face;

a second surface extending downwardly from the top face and positioned adjacent the first section of the traction face, the second surface being oriented generally perpendicular to the first surface along a height of the compactor cleat; and a bowl-shaped surface formed below the first and second surfaces and near the bottom face of the compactor cleat, the bowl-shaped surface forming a smooth transition between first and second surfaces and the perimeter of the bottom face.

* * * * *

UNITED STATES PATENT AND TRADEMARK OFFICE

CERTIFICATE OF CORRECTION

PATENT NO. : 9,334,620 B2
APPLICATION NO. : 14/328912
DATED : May 10, 2016
INVENTOR(S) : Brockway It is certified that error appears in the above-identified patent and that said Letters Patent is hereby corrected as shown below:

In the Specification

Col. 3, line 57, delete "fraction face" and
substitute therefore -- traction face --.

Col. 5, line 20, delete "fraction on" and
substitute therefore -- traction on --.

Signed and Sealed this
Ninth Day of August, 2016

Michelle K. Lee

Michelle K. Lee
*Director of the United States Patent and Trademark Office*